US006675724B2

(12) United States Patent
Bruschi et al.

(10) Patent No.: US 6,675,724 B2
(45) Date of Patent: Jan. 13, 2004

(54) DEVICE TO STABILIZE STACKING OF TABLES WITH FOLDING LEGS

(75) Inventors: Mario Bruschi, Bollate (IT); Diego Discacciati, East Brunswick, NJ (US)

(73) Assignee: Drake Corp., East Brunswick, NJ (US)

( * ) Notice: Subject to any disclaimer, the term of this patent is extended or adjusted under 35 U.S.C. 154(b) by 0 days.

(21) Appl. No.: 10/081,187

(22) Filed: Feb. 25, 2002

(65) Prior Publication Data

US 2002/0134285 A1 Sep. 26, 2002

(30) Foreign Application Priority Data

Feb. 23, 2001 (IT) ..... MI2001A0361

(51) Int. Cl.[7] ..... A47B 3/00
(52) U.S. Cl. ..... 108/91
(58) Field of Search ..... 108/53.1, 91, 132, 108/131, 129; 211/194; 312/111

(56) References Cited

U.S. PATENT DOCUMENTS 1,593,975 A * 7/1926 Karstens ..... 108/91
2,889,185 A * 6/1959 Heisler ..... 108/91
3,604,372 A * 9/1971 Hewett et al. ..... 108/160
3,845,728 A * 11/1974 Piretti ..... 108/131
4,626,047 A * 12/1986 Miciukiewicz ..... 312/107.5
5,284,100 A * 2/1994 Thorn ..... 108/129
5,638,761 A * 6/1997 Berkowitz et al. ..... 108/132
5,974,982 A * 11/1999 Lepper et al. ..... 108/132

FOREIGN PATENT DOCUMENTS

CH 588230 * 5/1977
DE 34 36 358 * 4/1986

* cited by examiner

*Primary Examiner*—Janet M. Wilkens
(74) *Attorney, Agent, or Firm*—Browdy and Neimark

(57) ABSTRACT

The device for stabilizing stacking up of tables (2) having folding legs (4) and a plate (3) provided with an edge (5), an upper face (6) and a lower face (7), comprises a latch element (12) movably connected to the plate (3) and a tooth (13) defining one end of the latch element (12). The latch element (12) is drivingly movable from a rest position to a work position at which the tooth (13) projects from the plate (3) to form a stop abutment preventing slipping with respect to an underlying table (2).

19 Claims, 4 Drawing Sheets

DEVICE TO STABILIZE STACKING OF TABLES WITH FOLDING LEGS

FIELD OF THE INVENTION

The invention relates to a device for stabilizing stacking up of tables having folding legs. More particularly it relates to a device for stabilizing stacking up of tables having a table top or surface which is smooth and homogeneous on the upper part thereof and possibly provided with finishing decorations, and ground-resting legs that can be folded under the work top or surface.

In this way the concerned tables while having a traditional and refined aspect, can take a greatly flattened shape and therefore can be easily stored when they are not in use.

In fact these tables can be stacked or piled up, with their tops substantially parallel and adjacent to each other.

DESCRIPTION OF THE PRIOR ART

It is known that tables of the above type not only have the merit of being adapted to carry out storing in reducing spaces, but they also have the important quality of enabling easy transportation of same by groups disposed in a stacked condition on trolleys or transport means.

Due to the above features, they are suitable for use as emergency tables or tables for hire so as to dispose them temporarily in areas or premises that are to be subsequently evacuated or cleared.

Beside the above mentioned qualities, a typical drawback of these tables is the reduced steadiness of the piles or stacks they form and therefore the small number of tables that can be practically piled up when the same are to be moved in a stacked condition on trolleys and the like.

In fact, the work tops or surfaces that are smooth and homogeneous on the upper part do not offer any hold for the overlying tables and deformations or cavities cannot be formed on the tops themselves so as to promote piling up or make it steady because in this way the concerned tables would loose an essential quality owned by them, i.e. that of having a smooth and uniform upper surface.

This upper surface is the surface most in sight and finishing, color and smoothness of same as well as possible decorations chiefly determine the apparent value of said tables.

To protect this surface when tables are piled up, annular bands or borders are provided to be extended under the table top so as to define a lower housing or niche within which the folded support legs are encased in such a manner that the same do not touch the upper surface of the underlying table.

Obviously the borders or bands forming said housing or niche are carefully finished so that they can rest on the upper surfaces of the underlying tables without damaging them. Practically, the tables being piled up can slide or slip in a coplanar relation with each other. The more finishing of said upper surface is accurate, the easier said slipping takes place.

Therefore, during transportation piling up of a relatively reduced number of tables as compared with the capacity of the transport trolleys must be each time provided, which results in a slowing down of the loading and unloading procedures.

Alternatively it is possible to resort to transport means ensuring the necessary steadiness by themselves, such as trolleys provided with different exactly-positioned holding borders, but this solution on the one hand makes it necessary to use special trolleys which are expensive and hardly suitable for other different uses and, on the other hand, makes the loading and unloading operations of the folded table stacks more difficult and therefore more time-consuming.

SUMMARY OF THE INVENTION

Under this situation the technical task underlying the invention is to conceive a device capable of substantially obviating the mentioned drawbacks.

Within the scope of this technical task it is an important aim of the invention to provide a device enabling the stacked tables to be stabilized without interventions on the upper surface of the tops being required and without any element potentially susceptible of damaging said surface being introduced.

Another important aim of the invention is to provide a device which is versatile and substantially applicable to all tables of the above type that are presently on the market.

A further aim of the invention is to provide a device of this type that does not interfere with other table components, in particular with the folding legs and the drive and control mechanisms of same.

A still further aim of the invention is to provide a device of this type that can act in a substantially automatic manner at the moment of piling.

A not least aim of the invention is to provide a device that can be produced together with the work tops or surfaces, for example when the latter are being manufactured.

The technical task mentioned and the aims specified are achieved by a device for stabilizing stacking up of tables having folding legs, and at least one plate provided with an edge, an upper face and a lower face, said folding legs extending from said lower face, the device comprising: at least one latch-like element movably connected to said plate and at least one tooth defining one end of said latch-like element, said latch-like element being drivingly movable from a rest position to a work position at which said tooth projects from said plate to make a stop abutment preventing slipping with respect to an underlying plate.

BRIEF DESCRIPTION OF THE DRAWINGS

Further features and advantages of the invention will become more apparent from the detailed description of preferred embodiments of a device in accordance with the invention, shown in the accompanying drawings, in which.

DETAILED DESCRIPTION OF THE PREFERRED EMBODIMENTS

Figure 1:
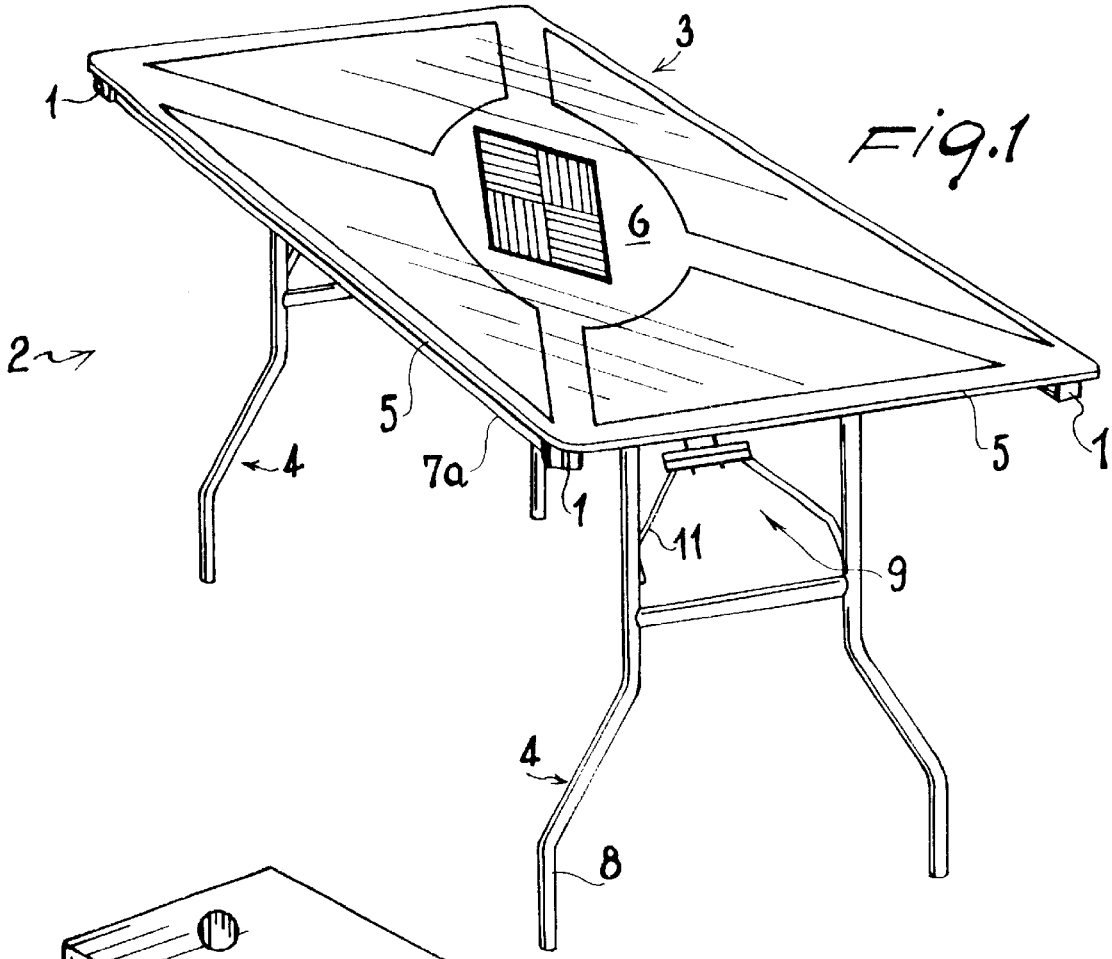
FIG. 1 is a diagrammatic and perspective view of a table provided with the device of the invention.

With reference to the drawings, the device in accordance with the invention is generally identified by reference numeral 1 and is shown when applied to a table 2 of the type comprising, in known manner, a main surface or plate 3 supported by folding legs 4.

Plate 3 extends in such a manner as to have a circular or quadrangular edge 5, a rectangular or square edge for example, an upper face 6 which is substantially flat and smooth and possibly with decorations, and a greatly shaped lower face 7.

In particular, the lower face 7 has at least two borders, bands or projections 7*a* extending close to edge 5 and jutting out in the direction of the ground, when the table 2 is in a position of use. The folding legs 4 are in engagement with plate 3 at the lower face 7 thereof and, when folded, are inserted in a niche confined by projections 7*a*.

Figure 4:
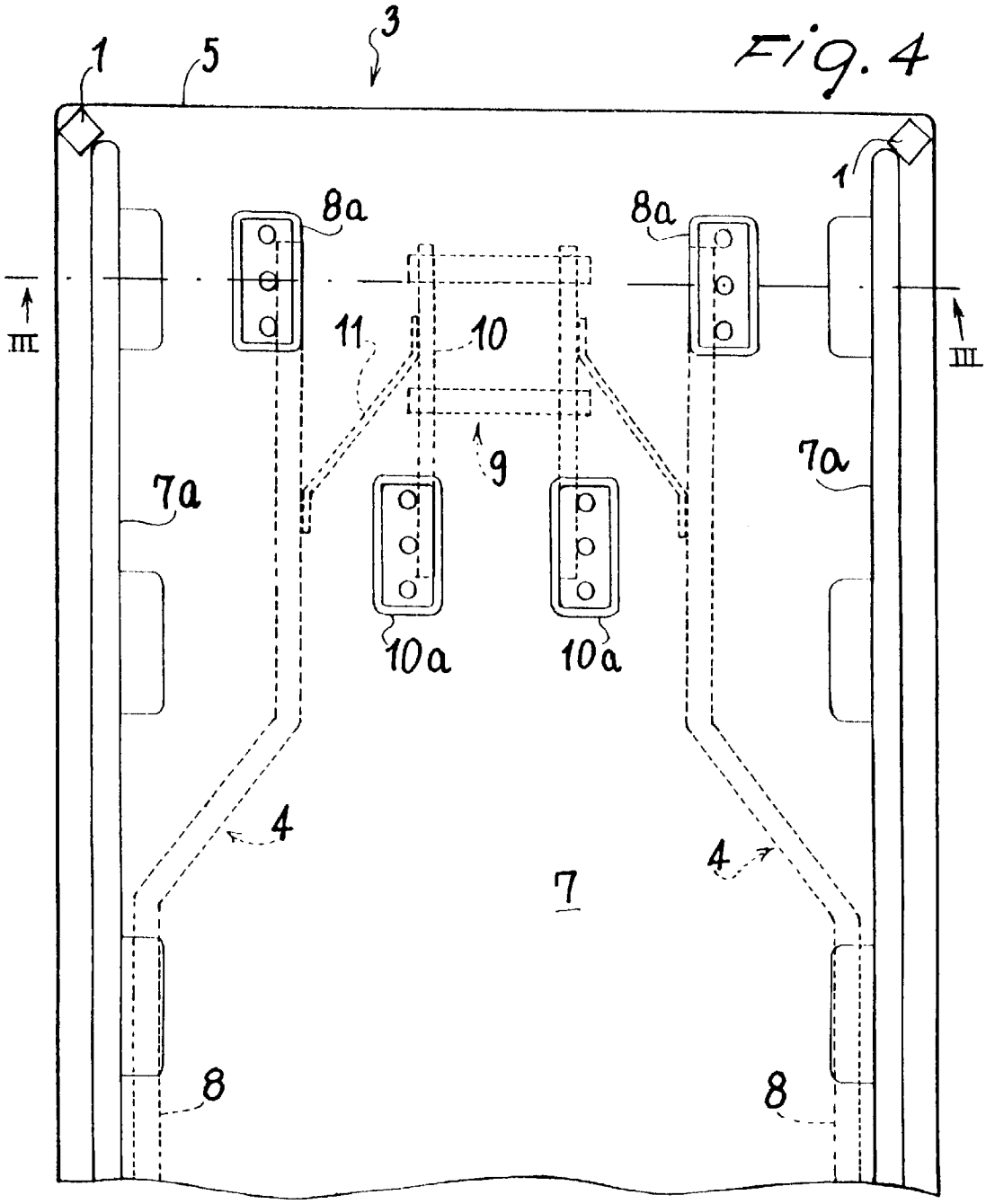
FIG. 4 is a view from below of a table provided with said device.

In detail, as shown in FIGS. 1 and 4, the folding legs 4 are preferably of metal material and have ground-resting elements 8 rotatably connected to plate 3 at first attachment pieces 8*a* and kinematic driving mechanisms for said legs generally identified by 9 and known by themselves.

For instance, the kinematic driving mechanisms 9 comprise struts 10 articulated on one side with plate 3 by means of second attachment pieces 10*a* and rotatably connected on the opposite side with the ground-resting elements 8 by means of connecting bars 11.

When the folding legs 4 are in the use position of table 2 and therefore in an unfolded condition, the ground-resting elements 8 extend from the first attachment pieces 8*a* in a direction away from plate 3 and the struts 10 and connecting bars 11 extend consecutively of each other in a direction transverse to the ground-resting elements 8, starting from the second attachment pieces 10. Said use position of table 2 is made steady by appropriate abutments adapted to particularly prevent rotation between the struts 10 and connecting bars 11.

On the contrary, when legs 4 are in a folded position, the ground-resting elements 8 extend from the respective first attachment pieces 8*a* in an opposite direction with respect to that according to which struts 10 extend from the respective second attachment pieces 10*a*.

In addition, in a folded position the struts 10 and connecting bars 11 extend in opposite directions with respect to each other.

Above all, the struts 10, connecting bars 11 and ground-resting elements 8 take a position adhering to plate 3 within the niche defined by projections 7*a*. Practically, in a folded position thickness of table 2 is defined by plate 3 and projections 7*a*. Thus, when tables are stacked up there is a contact between the projections 7*a* and the upper face 6 of the underlying table.

Obviously, projections 7*a* are given such a finishing at their ends that the surface of the upper surface 6 of the table cannot be damaged by them, this surface which is flat and smooth being the most in-sight surface and also being the most important for determining the qualitative level and good state of table 2. In addition, projections 7*a* can easily slide on the upper face 6 of a stacked table disposed below and exactly in order to avoid this sliding and stabilize the mutual position of the stacked tables without damaging their upper faces 6 or introducing surface irregularities thereon, provision is made for device 1 in accordance with the invention which is applicable to plate 3 on the side of the lower face 7 of same and close to edge 5.

Device 1 comprises at least one latch-like element 12 provided with at least one tooth 13 and adapted to oscillate between a work position and a rest position. The latch-like element 12 is preferably of one piece construction with tooth 13 and can be made of wood, plastic material or metal material.

In the work position (shown in solid lines in FIGS. 5, 6, 7) tooth 13 projects from the overall dimensions of plate 3 defined by edge 5 and embodies an abutment for engagement with an edge 5 of a plate 3' disposed below.

Figure 2:
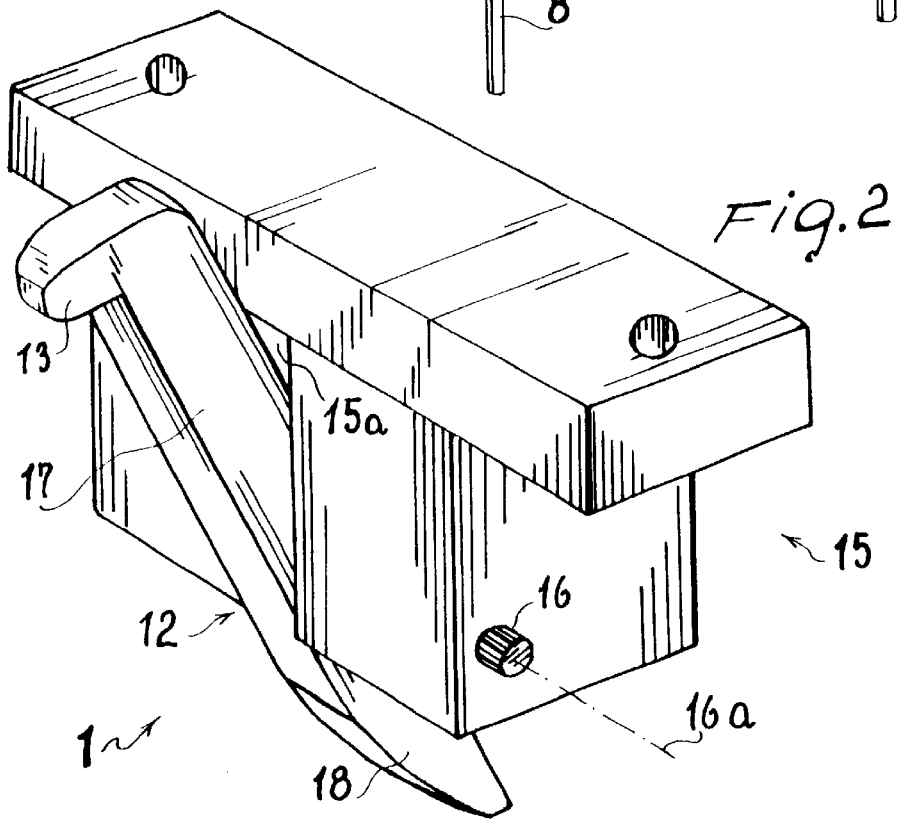
FIG. 2 is a diagrammatic and perspective view of the device of the invention in an isolated position.
Figure 3:
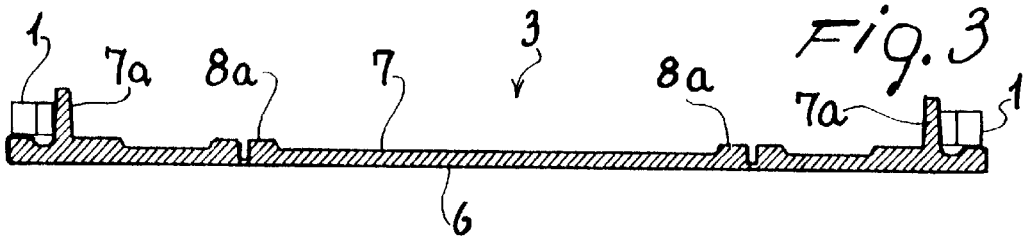
FIG. 3 is a sectional view of a table provided with said device, in an overturned position.

In the rest position (shown in FIG. 2 and in chain lines in FIGS. 5, 6, 7) tooth 13 is within the overall dimensions of plate 3 defined by edge 5, i.e. the overall dimensions in plan of plate 3 when the latter is disposed horizontally.

Figure 5:
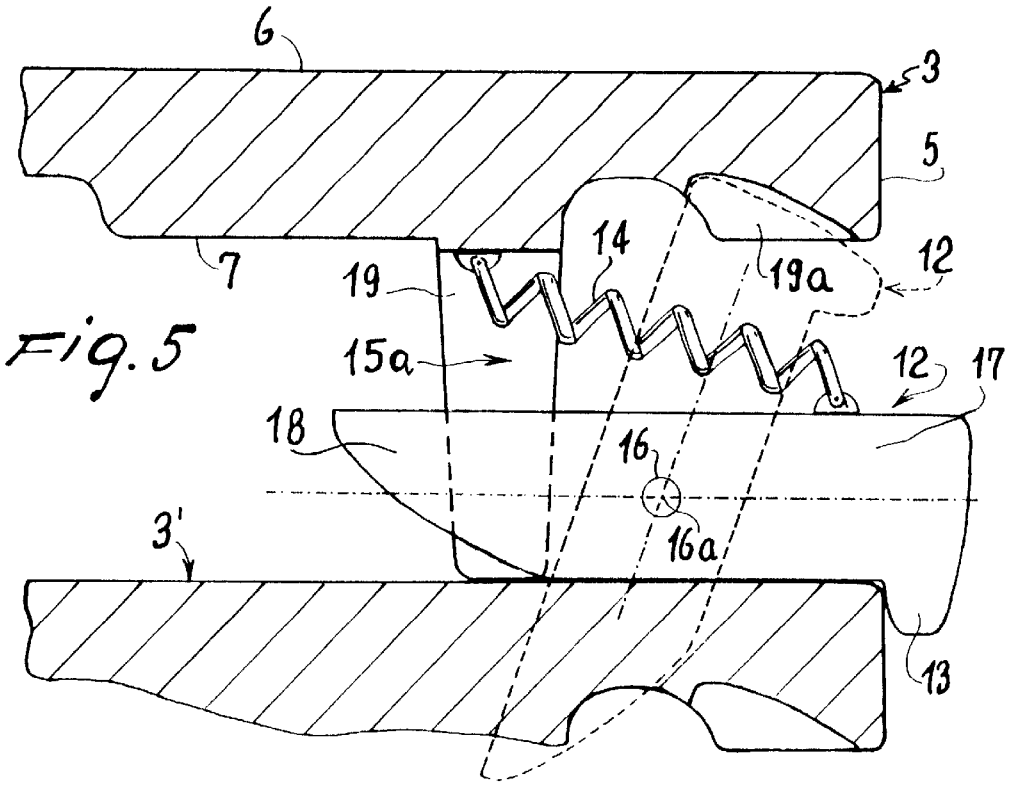
FIG. 5 is a detailed view in elevation and in section of the device according to a first embodiment thereof, showing operation of same.
Figure 6:
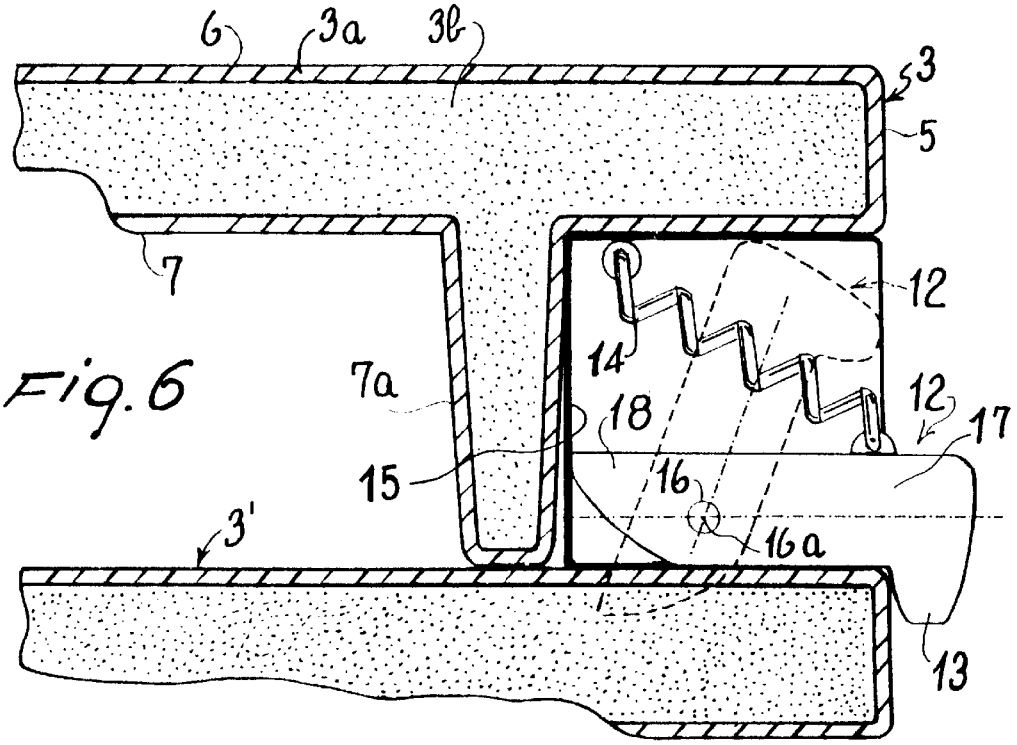
FIG. 6 is similar to the preceding one and shows the device in a second embodiment thereof and applied to a table of a material different from that of the table shown in FIG. 5.
Figure 7:
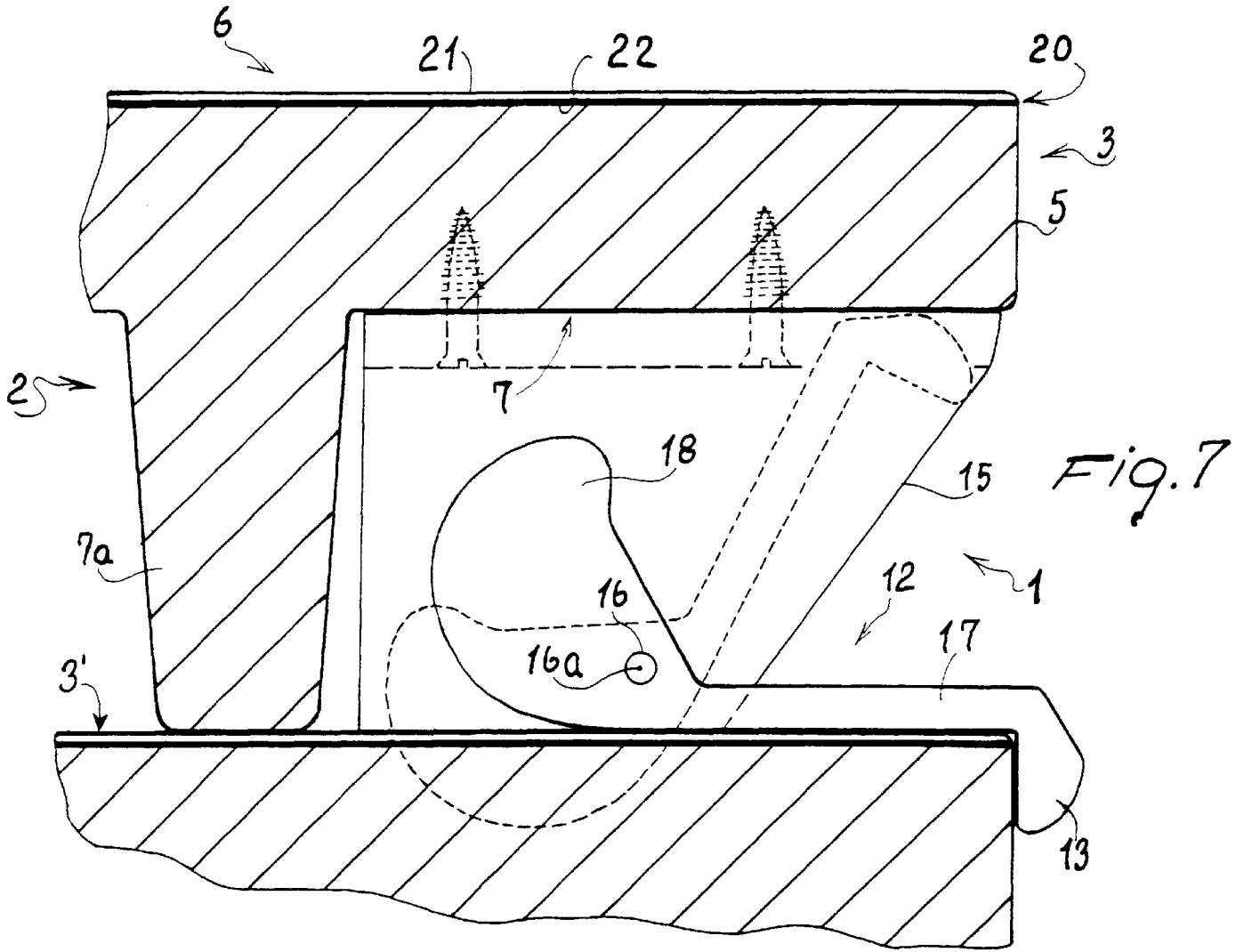
FIG. 7 is an elevation view of a third embodiment of the device, in two different operating positions.

FIGS. 5, 6, 7 also show that advantageously between two stacked plates, the work position is driven by the pressure exerted by the stacked plate disposed below, whereas the rest position is reached through the action of spring means 14 (FIGS. 5, 6) or through the weight of the latch-like element 12 (FIG. 7) when the latter is made suitably unbalanced.

In detail, device 1 comprises a fixed portion consisting of a shaped body 15 that, in the embodiments shown, is fastened by means of screws or by gluing, to plate 3 on the side of the lower face 7 thereof and at a region included between the edge 5 and one projection 7*a*.

The shaped body 15 substantially is a wood or plastic block and supports the latch-like element 12 by a pivot 16 or the like defining a rotation axis 16*a* for the latch-like element 12 substantially parallel to the upper face 6 of plate 3.

Movement between the work position and rest position therefore takes place by a rotation at pivot 16 adapted to raise tooth 13 towards the overlying upper surface 6 of plate 3.

For the purpose of housing part of the latch-like element 12, in particular tooth 13, the shaped body 15 is provided with a cavity 15*a* passed through by pivot 16. The latch-like element 12 consists of two portions extending in opposite directions starting from pivot 16. The first portion comprises a separation tailpiece 17 extending between tooth 13 and pivot 16, whereas the second portion comprises an activation tailpiece 18 extending on the opposite side from the separation tailpiece 17, with respect to pivot 16.

Due to the above structure of the latch-like element 12 the spring means 14 is active on the separation tailpiece 17 and the work position is driven by the pressure exerted on the activation tailpiece 18 by an underlying plate 3'. Tailpiece 18 has a cam-shaped portion and is therefore rounded and chamfered and possibly also provided with a felt pad or the like to avoid any damage to the underlying plate 3'.

As already pointed out, as an alternative to the draw-spring, unbalancing of the latch-like element 12 can be provided by making the activation tailpiece 18 of a heavier weight than the overall weight of the separation tailpiece 17 and tooth 13. The different weight can be obtained by means of different sizes, different thicknesses or different materials or resorting to inserts made of lead for example, present in the activation tailpiece 18.

The shaped body 15 may have a very simple shape, for example when its task is merely to make a connection between plate 3 and pivot 16, for supporting the latter, or it may have wider sizes to protect and conceal the latch-like element 12 as much as possible.

In particular, the shaped body 15 preferably has a notch or seating 15*a* (FIG. 2) to house the latch-like element 12 at least partly and the seating 15*a* may be hollowed out in the shaped body 15 or formed by moving two portions of said body close to each other.

The activation tailpiece 18 shown in FIG. 5 projects from the seating 15*a* and the shaped body 15 and enters a hollow 19 formed in the projection 7*a* of plate 3. Also formed close to edge 5 is a second hollow 19*a* adapted to house and also protect tooth 13 in its rest position, so that said tooth does not project from edge 5.

In FIG. 6 no hollow is formed in plate 3 and the activation tailpiece 18 may be completely internal to the shaped body 15 when the work position is reached. The last-mentioned technical solution enables the shaped body 15 to be freely disposed without any risk of interference, taking into account the fact that the spring means 14 too is shown as directly in engagement with the shaped body 15.

In FIG. 7 the shaped body 15 and seating 15*a* are particularly wide so as to protect the separation tailpiece 17 and above all tooth 13 when the latch-like element 12 is in the rest position, and to house the activation tailpiece 18 in the work position.

When the sizes of the latch-like element 12 do not require formation of hollows 19, 19*a* in plate 3 and the spring means 14 is directly in engagement with the shaped body 15 or is replaced with a weight unbalance of said tailpieces 17 and 18, device 1 advantageously appears like a self-governing structure to be freely positioned, in a provisional manner too, by means of non permanent adhesives. Three devices 1 may be connected with said table 2 in the case of a circular plate 3, whereas if the plate 3 is of quadrangular shape devices 1 may be four in number and they are conveniently spaced apart from each other, each on one side of plate 3 for example, close to edge 5, or close to the corners as shown in FIGS. 1 and 4. Positioning said devices at the corners enables better concealment of same because users of table 2 usually do not seat at the table corners.

The device 1 in accordance with the invention may be also made as an integral part of a table with folding legs 4, of the already described type.

In particular the fixed portion of device 1 may consist of a shaped portion of plate 3, or of said shaped body 15, when the same is of one piece construction with plate 3. For the purpose the plate 3 and shaped body 15 can be advantageously made of plastic material such as preferably a compact, semi-expanded or two-component thermoplastic resin.

Shown in FIG. 6 is an injection-molded plate 3 obtained from a two-component plastic material. It comprises an outer shell 3*a* of a plastic material of high hardness such as compact polypropylene, and a filling core 3*b* of a plastic material of high toughness such as semi-expanded polypropylene.

The plastic material forming the outer shell 3*a* is introduced by high-temperature injection into a mold and the plastic material forming the filling core 3*b* is injected afterwards. The plastic material forming the outer shell 3*a* solidifies at once on its side facing the mold walls, whereas its central part keeps hotter and fluid and therefore can be easily perforated and passed through by the plastic material forming the filling core 3*b*.

Arrangement of a plate 3 of plastic material is also advantageous because it enables a decorated upper layer 20, made of the same plastic material as that of plate 3 or one material compatible therewith to be applied to the upper face 6. Preferably the upper layer 20 comprises a transparent sheet 21 and a decoration sheet 22 disposed between the plate 3 and the transparent sheet 21. Sheets 21 and 22 form a single body with plate 3 and this is for example obtained by inserting sheets 21 and 22 in the mold for making plate 3 before injection of the plastic material forming the plate itself.

Operation of the device is as follows.

In its normal use position of the tables, shown in FIG. 1, devices 1 have no specific function.

In a rest position device 1 has the activation tailpiece 18 projecting away from the lower face 7, also below projections 7*a*, and tooth 13 is raised due to the action of the spring means 15 or the unbalanced structure of the latch-like element 12, when the latter has an oversized activation tailpiece 18.

When tables are to be removed and piled up, the folding legs 4 are folded close to the lower face 7 of plate 3 in the niche defined by projections 7*a*. Plates 3 are then disposed upon each other in such a manner that projections 7*a* rest on the upper faces 6 of respective underlying plates 3'.

Piling up and transportation take place, at least firstly, on normal trolleys of easy loading and suitable for plates 3 of different sizes.

Under this situation slipping between plates 3 is prevented by device 1 disposed on the lower faces 7 of each plate 3.

In fact, when plates 3 are stacked up, compression of the activation tailpieces 18 gives rise, as a result, to rotation of the latch-like element 12 around pivot 16 with lowering of tooth 13. This lowering brings tooth 13 to the position shown in solid lines in FIGS. 5, 6 and 7, at which the tooth itself acts as an abutment to an edge 5 of an underlying plate 3', thereby restraining it from sliding.

The invention achieves important advantages.

In fact the device as provided is of simple structure, low cost and, if not made together with plate 3, also of easy installation without requiring any intervention intended to modify plate 3. Even after application of the device, the edge 5 and upper surface 6 which are the table elements most in sight, are left completely free.

In addition the device acts in an automatic manner, exactly when stacking takes place and therefore can be used without paying attention to it.

Due to the presence of device 1 big piles of tables 2 can be formed without risks of slipping and therefore more quickly and with reduced expenses for transport, always using trolleys of the common type.

Devices 1 can be applied in a permanent manner to tables 2 that are devoid of them, by means of screws or by permanent gluing. They can also be temporarily applied through removable gluing at the moment of piling them up. Alternatively, they can be an integral part of tables advantageously made of plastic material.

What is claimed is:

1. A device for stabilizing stacking up of tables each having folding legs, and at least one plate provided with an edge, an upper face and a lower face, said folding legs extending from said lower face, the device comprising:

at least one latch element movably connected to said plate and at least one tooth defining one end of said latch element, said latch element being drivingly movable from a rest position to a work position at which said tooth projects from said plate to make a stop abutment preventing slipping with respect to a plate of an underlying table.

2. The device as claimed in claim 1, wherein said latch element is positioned close to said edge and in which said tooth, when in said work position, projects both from said lower face and from said edge of said plate, to make an abutment for an edge of an underlying plate.

3. The device as claimed in claim 1, wherein said latch element comprises an activation tailpiece disposed apart from said tooth and projecting from said lower face, in said rest position, said work position of the latch element being driven by the pressure exerted on said activation tailpiece by a plate of an underlying plate.

4. The device as claimed in claim 3, comprising spring means for controlling oscillations of said latch element and wherein said latch element is movable from said work position to said rest position under the action of said spring means.

5. The device as claimed in claim 3, wherein said activation tailpiece has a predominant weight in said latch element, said latch element being movable from said work position to said rest position by effect of the weight of said activation tailpiece.

6. The device as claimed in claim 3, wherein said activation tailpiece has a cam-shaped portion for slidingly engaging the plate of an underlying table.

7. The device as claimed in claim 1, comprising a pivot which is substantially fixed relative to said plate and defines a rotation axis for said latch element, displacement of said latch element from said work position to said rest position taking place by rotation about said pivot.

8. The device as claimed in claim 7, wherein said latch element comprises a separation tailpiece extending between said tooth and said pivot and an activation tailpiece extending on the opposite side from said separation tailpiece, with respect to said pivot.

9. The device as claimed in claim 1, comprising a shaped body in engagement with said plate, at said lower face, said shaped body defining a cavity adapted to house part of said latch element.

10. The device as claimed in claim 9, wherein said cavity of said shaped body has a shape adapted to house said tooth when said latch element is in said rest position.

11. The device as claimed in claim 9, comprising a pivot defining a rotation axis for said latch element said pivot being supported by said shaped body.

12. The device as claimed in claim 9, wherein said shaped body is removably connected to said plate.

13. A table with folding legs having a plate provided with an edge, an upper face and a lower face, said folding legs extending from said lower face, the table comprising at least one device for stabilizing stacking up of at least another table, said device comprising:

at least one latch element movably connected to said plate and at least one tooth defining one end of said latch element, said latch element being drivingly movable from a rest position to a work position at which said tooth projects from said plate so as to make a stop abutment preventing slipping with respect to a plate of an underlying table.

14. The table as claimed in claim 13, wherein said plate is of quadrangular shape and said at least one device is disposed at at least one corner of said plate.

15. The table as claimed in claim 13, wherein said plate has a shaped lower face comprising projections adapted to define a niche for said folding legs, and wherein said device is positioned between said projections and said edge.

16. The table as claimed in claim 13, wherein said device comprises a shaped body defining a cavity adapted to house part of said latch element, and wherein said shaped body is removably connected to said plate, at said lower face.

17. The table as claimed in claim 13, wherein said device comprises a shaped body defining a cavity adapted to house part of said latch element, and wherein said plate and shaped body are at least mostly made from an injection molded plastic material.

18. The table as claimed in claim 17, comprising an upper layer at said upper face of said plate, said upper layer being made of a plastic material and including a transparent sheet and a decorative sheet placed between said transparent sheet and said plate.

19. The table as claimed in claim 17, wherein said injection molded plastic is polypropylene selected from the group consisting of a compact polypropylene, a semi-expanded polypropylene and a two-component polypropylene.

* * * * *